US011069953B2

(12) United States Patent
Rogers et al.

(10) Patent No.: US 11,069,953 B2
(45) Date of Patent: Jul. 20, 2021

(54) ELECTRICALLY SMALL ANTENNA

(71) Applicant: The Boeing Company, Chicago, IL (US)

(72) Inventors: John E. Rogers, Owens Cross Roads, AL (US); John D. Williams, Decatur, AL (US)

(73) Assignee: THE BOEING COMPANY, Chicago, IL (US)

( * ) Notice: Subject to any disclaimer, the term of this patent is extended or adjusted under 35 U.S.C. 154(b) by 157 days.

(21) Appl. No.: 16/141,606

(22) Filed: Sep. 25, 2018

(65) Prior Publication Data

US 2020/0099122 A1 Mar. 26, 2020

(51) Int. Cl.

| | |
|---|---|
| ***H01Q 1/38*** | (2006.01) |
| ***H01Q 13/10*** | (2006.01) |
| ***H01Q 1/22*** | (2006.01) |
| ***H01Q 21/00*** | (2006.01) |
| ***H01Q 1/48*** | (2006.01) |

(52) U.S. Cl.

CPC ..... *H01Q 1/2283* (2013.01); *H01Q 1/48* (2013.01); *H01Q 21/0075* (2013.01)

(58) Field of Classification Search

CPC ..... H01Q 1/2283; H01Q 1/22; H01Q 1/48; H01Q 21/00; H01Q 21/0075; H01Q 1/38; H01Q 13/10; H01Q 13/106; H01Q 21/06; H01Q 21/064; H01Q 21/065; H01Q 9/04; H01Q 9/0428; H01Q 9/0457

See application file for complete search history.

(56) References Cited

U.S. PATENT DOCUMENTS

| | | | | |
|---|---|---|---|---|
| 4,070,676 A * | 1/1978 | Sanford | ..... | H01Q 9/0414 343/700 MS |
| 5,001,492 A * | 3/1991 | Shapiro | ..... | H01P 5/187 333/116 |
| 5,400,042 A * | 3/1995 | Tulintseff | ..... | H01Q 21/24 343/727 |
| 5,767,808 A * | 6/1998 | Robbins | ..... | H01Q 9/0407 343/700 MS |
| 5,914,693 A * | 6/1999 | Takei | ..... | H01Q 13/16 343/700 MS |
| 6,384,785 B1 * | 5/2002 | Kamogawa | ..... | H01Q 1/38 343/700 MS |

(Continued)

OTHER PUBLICATIONS

Pozar, D.M., "Microstrip Antenna Aperturecoupled to a Microstripline", Electronics Letters, Jan. 1985, pp. 49-50, vol. 21, No. 2.

(Continued)

*Primary Examiner* — Tho G Phan
(74) *Attorney, Agent, or Firm* — Gates & Cooper LLP

(57) ABSTRACT

An electrically small low profile antenna is disclosed. The antenna comprises circuit board comprising a composite laminate, formed of a magnetic material and having at least one antenna element disposed on a top surface of the composite laminate, a conductive ground plane disposed on a bottom surface of the composite laminate, and a conductor, extending through the composite laminate between the top surface and the bottom surface of the composite laminate, the conductor forming a microstrip feed extending from an antenna input to the antenna element.

21 Claims, 8 Drawing Sheets

(56) References Cited

U.S. PATENT DOCUMENTS

2019/0312358 A1* 10/2019 Rogers ..... H05K 3/4673

OTHER PUBLICATIONS

Pozar, D.M., et al., "Increasing the bandwidth of a microstrip antenna by proximity coupling", Electronics Letters, Apr. 1987, pp. 368-369, vol. 23, No. 8.

Pozar, D.M., et al., "Magnetic tuning of a microstrip antenna on a ferrite substrate", Electronics Letters, Jun. 1988, pp. 729-731, vol. 24, No. 12.

Rainville, P.J., et al., "Magnetic Tuning of a Microstrip Patch Antenna Fabricated on a Ferrite Film", IEEE Microwave and Guided Wave Letters, Dec. 1992, pp. 483-485, vol. 2, No. 12.

Sun, N.X., et al., "Electronically tunable magnetic patch antennas with metal magnetic films", Electronics Letters, Apr. 2007, pp. 1-2, vol. 43, No. 8.

Yang, G-M., et al., "Tunable Miniaturized Patch Antennas With Self-Biased Multilayer Magnetic Films", IEEE Transactions on Antennas and Propagation, Jul. 2009, pp. 2190-2193, vol. 57, No. 7.

* cited by examiner

ELECTRICALLY SMALL ANTENNA

BACKGROUND

1. Field

The present disclosure relates to systems for receiving and transmitting signals, and in particular to an electrically small low profile antenna and methods for producing same.

2. Description of the Related Art

Low profile sensor nodes are useful in many applications, including structural health monitoring and diagnostic testing. With regard to structural health monitoring, low profile antennas in sensor nodes can gather information about an aircraft in real-time, including airframe characteristics (e.g., hoop stress, shear stress, compression, corrosion resistance, bending, torsion, crack growth, high local loads, longitudinal stress and impacts). With regard to diagnostic testing, low profile antennas in sensor nodes can be used for worker safety and aircraft condition monitoring on the factory floor.

Unmanned aerial vehicles (UAVs) typically need light weight antennas with low radar cross sections and low air drag for improved efficiency. Also, like other aircraft, UAV surfaces are typically either metallic or a carbon fiber material, which are conductive in nature and may change the behavior of an antenna.

Existing planar antennas including co-planar microstrip feed and pin feed antennas are inherently bandwidth-limited due to their resonant nature. Furthermore, patch antennas based on existing dielectric materials have very small bandwidths at lower frequencies (i.e., <900 MHz) making them undesirable for low frequency applications. due to existing dielectric materials limit the operating frequencies of patch antennas. What is needed is a low profile antenna with enhanced bandwidth characteristics. There is also a need for low profile antennas with reduced size and weight to permit their installation in a greater number of candidate locations and applications.

SUMMARY

To address the requirements described above, this document discloses an electrically small antenna and a method for producing same. One embodiment is evidenced by a low profile antenna, comprising: circuit board that has a composite laminate, formed of a magnetic material. The composite laminate has at least one antenna element disposed on a top surface of the composite laminate, a conductive ground plane disposed on a bottom surface of the composite laminate, and a conductor, extending through the composite laminate between the top surface and the bottom surface of the composite laminate, the conductor forming a microstrip feed extending from an antenna input to the antenna element.

In one embodiment the at least one antenna element comprises an antenna element portion and a slot; and at least a portion of the microstrip feed is disposed within the composite laminate between the slot and the bottom surface conductive ground plane. In another embodiment, the top surface comprises an array of a plurality of antenna elements, each comprising an associated slot, and at least a portion of the microstrip feed is disposed within the composite laminate between each of the array of the plurality of antenna elements and the bottom surface conductive ground plane. In a still further embodiment, the conductor further forms one or more power dividers disposed between the at least a portion of the microstrip feed disposed under each of the array of the plurality of antenna elements. In any of the foregoing embodiments, the composite laminate may have a thickness of, for example, 500 mil (0.5 inches) and the magnetic material a relative permittivity of, for example, 37-38.

Another embodiment is evidenced by a method of forming a low profile antenna, comprising: disposing at least one conductive antenna element on a top surface of a first magnetic layer, disposing a conductor on a top surface of a second magnetic layer or a bottom surface of the first magnetic layer, laminating the first magnetic layer and the second magnetic layer. Upon lamination, the conductor extends from an antenna input to under the conductive antenna element; and at least a portion of the conductor forms a microstrip between the second magnetic layer and the bottom surface conductive ground plane. Still another embodiment is evidence by a low profile antenna, formed by the method steps described above.

BRIEF DESCRIPTION OF THE DRAWINGS

Referring now to the drawings in which like reference numbers represent corresponding parts throughout.

DESCRIPTION

In the following description, reference is made to the accompanying drawings which form a part hereof, and which is shown, by way of illustration, several embodiments. It is understood that other embodiments may be utilized, and structural changes may be made without departing from the scope of the present disclosure.

Overview

In this disclosure, a bandwidth-enhanced low profile antenna is presented. Bandwidth is enhanced by using an aperture coupled antenna element with an inclusive slot, microstrip feed network, and lower ground plane. The antenna element and lower ground plane enclose a magnetic medium. The inclusive slot decreases the axial ratio and increases the circular polarization bandwidth, which is desirable for lower power loss due to misalignment between transmitter and receiver antennas. The lower ground plane minimizes any change in the antenna's electrical behavior due to the presence of conductive surfaces; better known as "surface agnostic" behavior.

The antenna comprises a number of features which can be characterized by a number of embodiments. Such features may also be combined in selected embodiments as disclosed further herein. One feature is that the antenna has an embedded RF microstrip network electrically coupled to a lower ground plane for efficient signal propagation and simplification of planar arraying. Another feature is that the antenna has a lower ground plane to minimize any change in the antenna's electrical behavior due to conductive surfaces. Still another feature is that the antenna uses aperture coupled antenna elements for simplistic feeding, planar arraying, reduction of antenna failure due to flexure, and simplified fabrication. A further feature is that the antenna utilizes a low-loss magnetic medium that results in an electrically small antenna (i.e., antenna wavelength in magnetic medium much shorter than equivalent wavelength in free-space) with high impedance bandwidth. A still further feature is that the antenna can utilize thin RF dielectrics for low profile applications due to the use of an aperture coupled feed. Still another feature is that the antenna is circularly polarized with increased bandwidth by using aperture coupled antenna elements with inclusive slots to lower power loss due to misalignment between transmitter and receiver antennas.

Figure 1A:
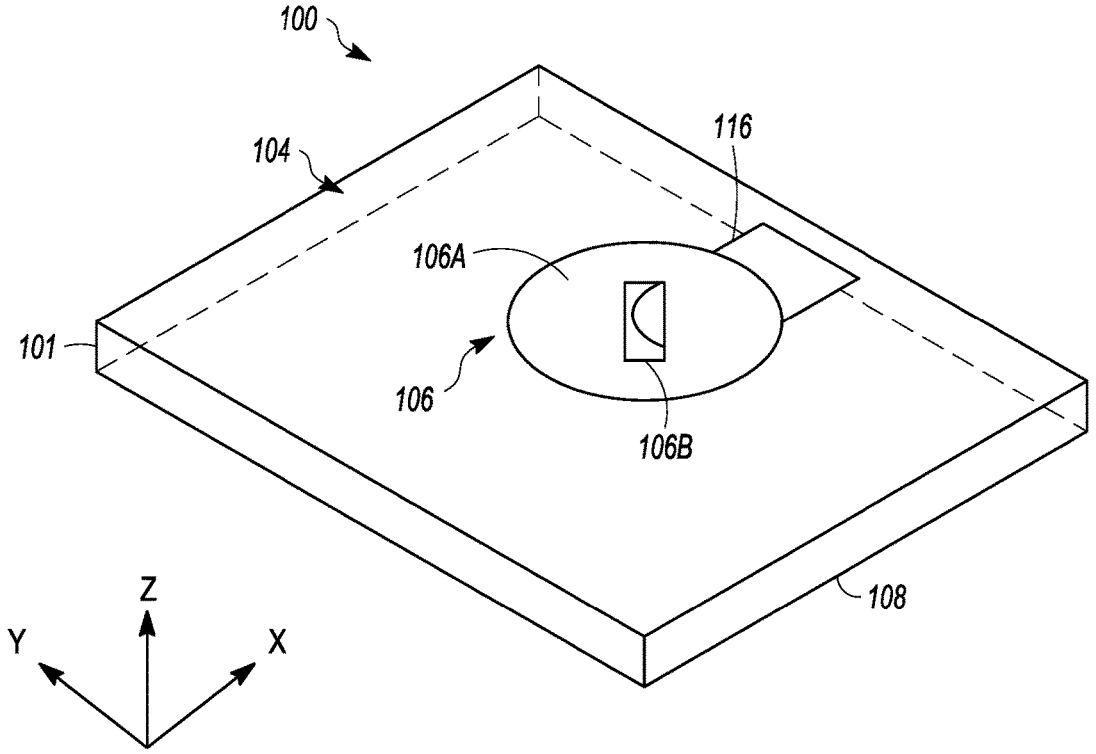
FIGS. 1A-1B are diagrams illustrating embodiments of an electrically small antenna.
Figure 1B:
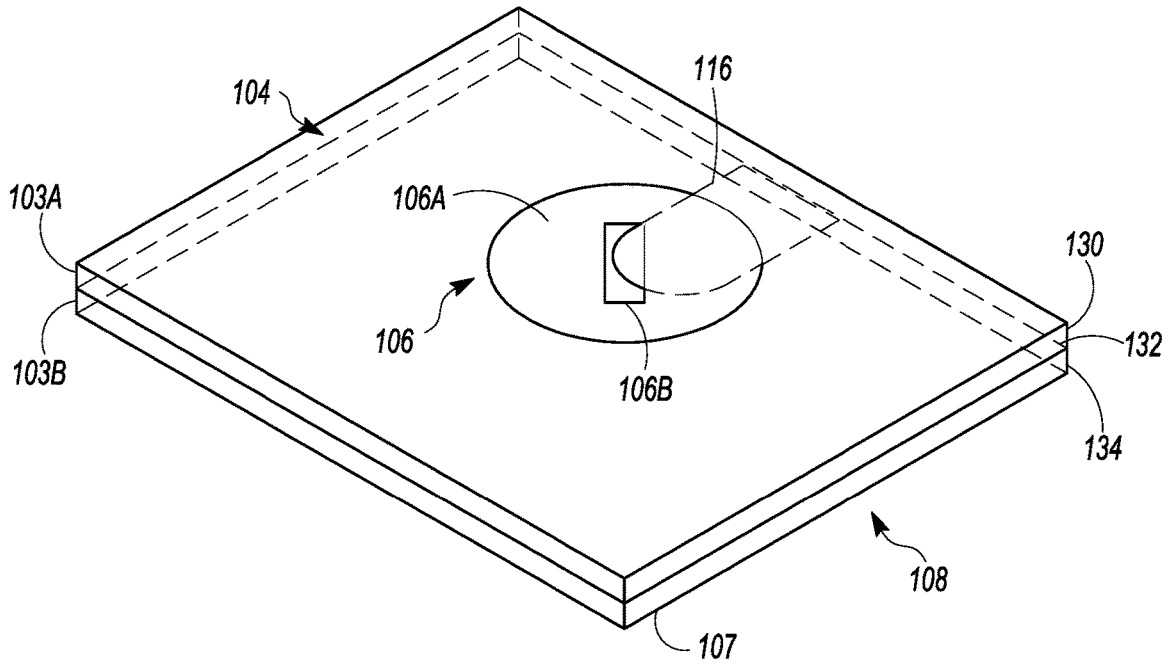

FIGS. 1A-1B are diagrams illustrating embodiments of an electrically small low profile antenna 100. Turning first to FIG. 1A, the antenna 100 has a magnetic material 103 having a top surface 104 and a bottom surface 108. The bottom surface 108 comprises a conductive ground plane 107. A microstrip feed is formed by a conductor 116 disposed within the magnetic material 103 between the top surface 104 and the bottom surface 108. The top surface 104 has at least one an aperture coupled antenna element 106 that comprises a conductive antenna element portion 106A having a conductive surface with a slot (or aperture) 106B therein. This aperture 106B electrically couples the antenna element 106 to the microstrip feed, and the microstrip feed is electrically coupled to the ground plane 107 on the bottom surface 108 of the antenna 100.

FIG. 1B is a diagram illustrating the use of multiple layers in the construction of one embodiment of the antenna 100. As illustrated, the antenna 100 is implemented using layers of magnetic material 103 including first layer 103A and second layer 103B. Antenna element 106 with the inclusive slot 106B is disposed in metal layer 130 (metal layer 1), while the conductor forming the microstrip feed line is disposed in metal layer 132 (metal layer 2), and the bottom surface ground plane 107 is disposed in metal layer 134 (metal layer 3). Hence, two magnetic layers 103A and 103B separate three metal layers 130, 132, and 134. The dimensions of the antenna element 106 with inclusive slot 106B (i.e., diameter of the antenna element portion 106A, the length of the slot 106B and the width of the slot 106B) are determined to maximize radiated power at the desired operating frequency of the antenna 100.

Figure 1C:
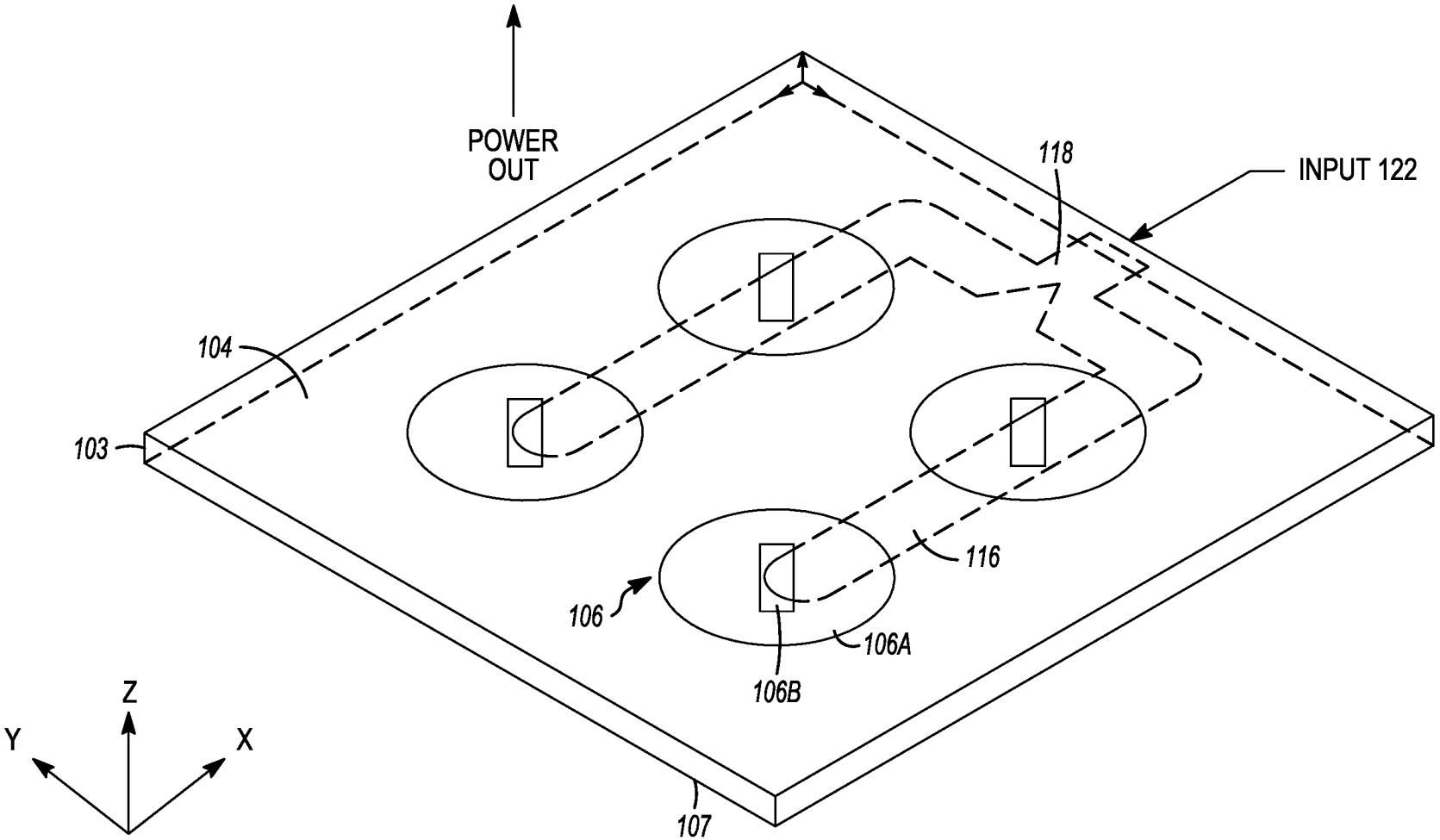
FIG. 1C is a diagram illustrating a perspective view of an embodiment of an electrically small antenna comprising a plurality of antenna elements.

FIG. 1C is a diagram illustrating a perspective view of an embodiment of the antenna 100 comprising a 2×2 array of antenna elements 106. In this embodiment, the antenna 100 has an RF circuit board 101 formed of magnetic material 103. The array of antenna elements 106 is disposed on a top planar surface 104. The RF circuit board 101 also comprises a bottom planar surface 108 having a bottom surface ground plane 107. The conductor 116 extends through circuit board 101 and forms a microstrip with the bottom surface ground plane 107. The conductor 116 also includes one or more power dividers 118 disposed along the X-axis between the antenna input 122 and the antenna elements 106. The power dividers 118 divide the antenna input into signals of reduced power that are thereafter provided to downstream antenna elements 106.

A finite element model analysis of this 2×2 array designed to operate near 350 MHz with an antenna element 106 diameter of 80 mm and two layers of 250 mil thick MAGTREX 555 provides an antenna gain of −3.5 dBi and an electrical impedance bandwidth of 120 MHz or 34%, and weighs only about 7.1 lbs. For comparison, a DPV-95 dipole antenna operating 225 to 400 MHz has a length of 177 in., 0 dBi gain, and antenna weight of −37.5 lbs. Although the foregoing illustrates a 2×2 array, the array may be non-square and may have a greater or lesser number of antenna elements 106.

Figure 2A:
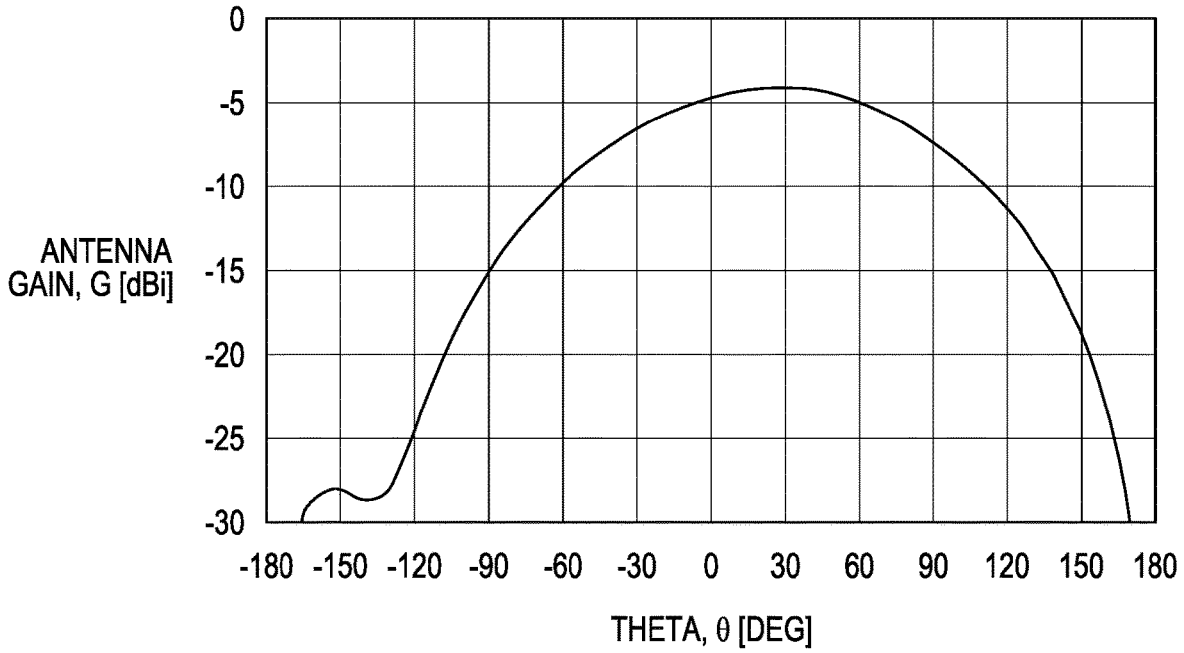
FIGS. 2A and 2B are diagrams depicting plots of the predicted performance of the electrically small antenna illustrated in FIGS. 1A and 1B.
Figure 2B:
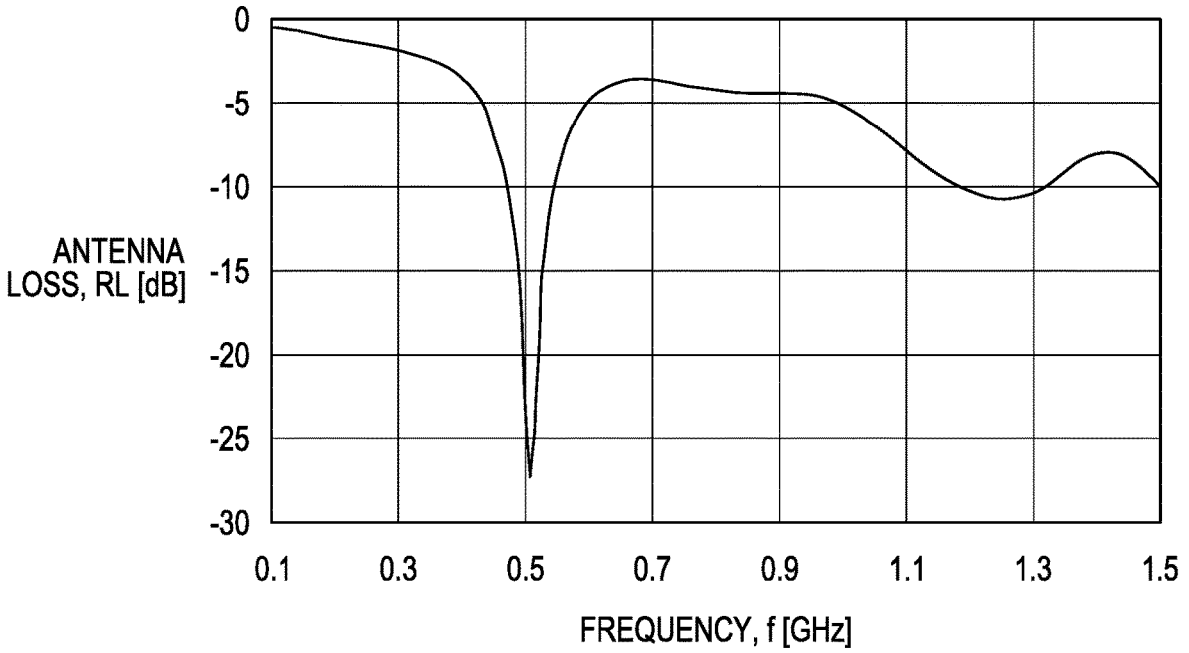

FIGS. 2A and 2B are diagrams depicting plots (generated with a finite element model (FEM) solver) of the predicted performance of an electrically small antenna 100 such as is illustrated in FIGS. 1A and 1B designed to operate near 500 MHz, with an antenna element 106 diameter of 56 mm, and the magnetic material 103 is composed of two layers of a high impedance laminate known as MAGTREX 555 having a permittivity of about 37-38, each having a thickness of 250 mil (e.g. 0.250 inches). With these design parameters, a typical antenna 100 will weigh approximately 0.8 lbs. For comparison, a DPV-54 dipole antenna available from the ANTENNA PRODUCTS CORPORATION operating between 400 to 500 MHz has a length of 24 in., antenna gain of 0 dBi, and weighs 4 lbs. Furthermore, unlike the DVP-54, which largely tubular in shape, electrically small antenna 100 is low-profile (resulting in low air drag and low visibility) and is also surface agnostic.

Similarly, a 2×2 array such as that illustrated in FIG. 1C designed to operate near 350 MHz, with an antenna element 106 diameter of 80 mm, and the magnetic material 103 composed of two 250 mil thick layers of MAGTREX 555 has a weight of 7.1 lbs. For comparison, a DPV-95 dipole antenna operating between 225 to 400 MHz has a length of 177 in., antenna gain of 0 dBi, and weighs 37.5 lbs.

FIG. 2A is a plot of antenna gain (dBi) versus angle (degrees) in the X-Z plane. As shown in FIG. 2A, the results predict a peak antenna gain of about −4 dBi. FIG. 2B is a plot of return loss (dB) as a function of frequency (GHz). The results demonstrate an electrical impedance bandwidth (determined by the −10 dB loss points) of more than 15%, which is significantly higher than that of which can be achieved with existing planar antennas based on existing dielectric materials.

Figure 2C:
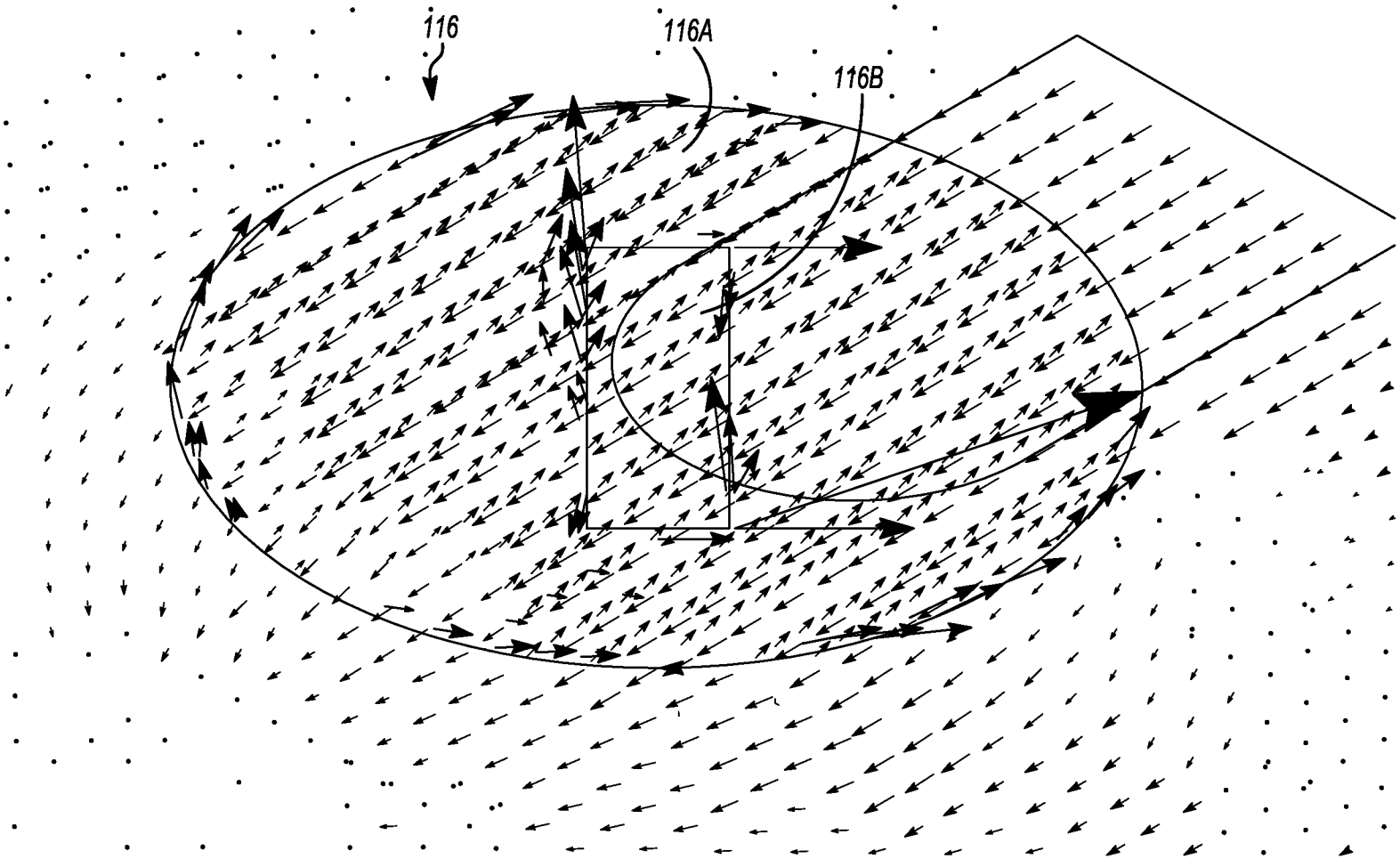
FIG. 2C is a diagram of a field plot showing the current density in vector form for the electrically small antenna operating at 500 MHz.

FIG. 2C is a diagram illustrating the current density (A/m) for the electrically small antenna shown in FIGS. 1A and 1B with the above physical characteristics operating at 500 MHz. The antenna element with inclusive slot electrically couples to the microstrip line, and the circular rotation of the current is indicative that the inclusive slot of the patch is forcing the current to rotate, resulting in circular polarization.

Figure 3:
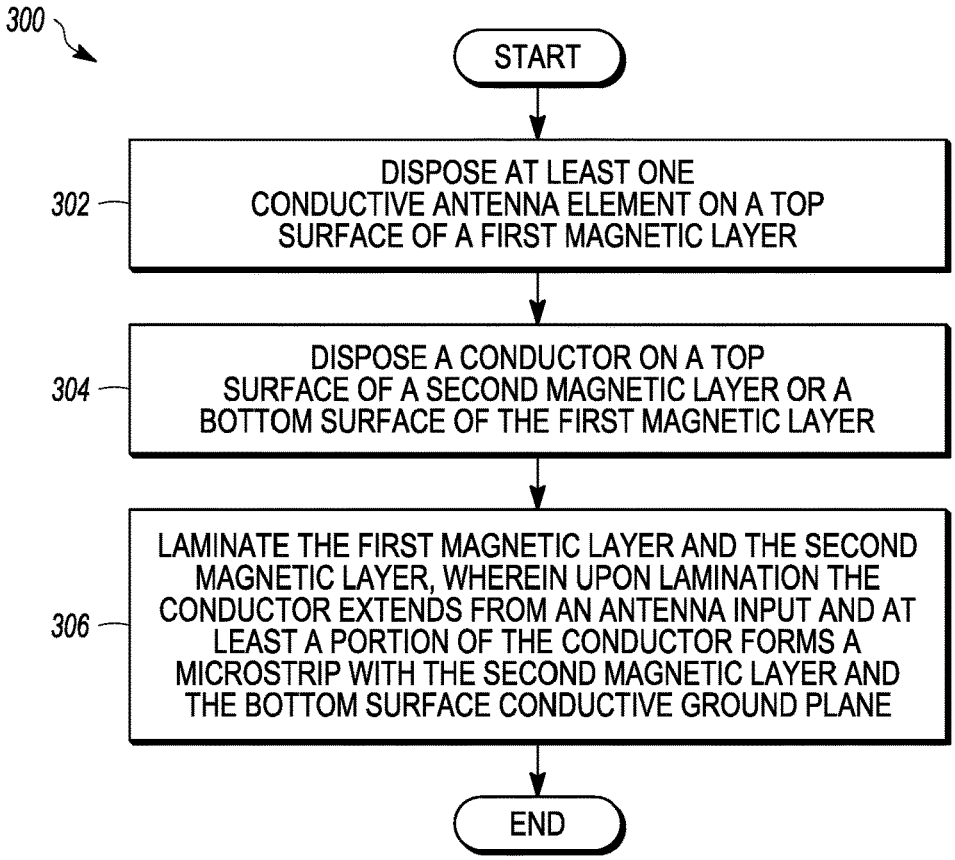
FIG. 3 is a diagram illustrating exemplary operations that can be used to produce the electrically small antenna.
Figure 4:
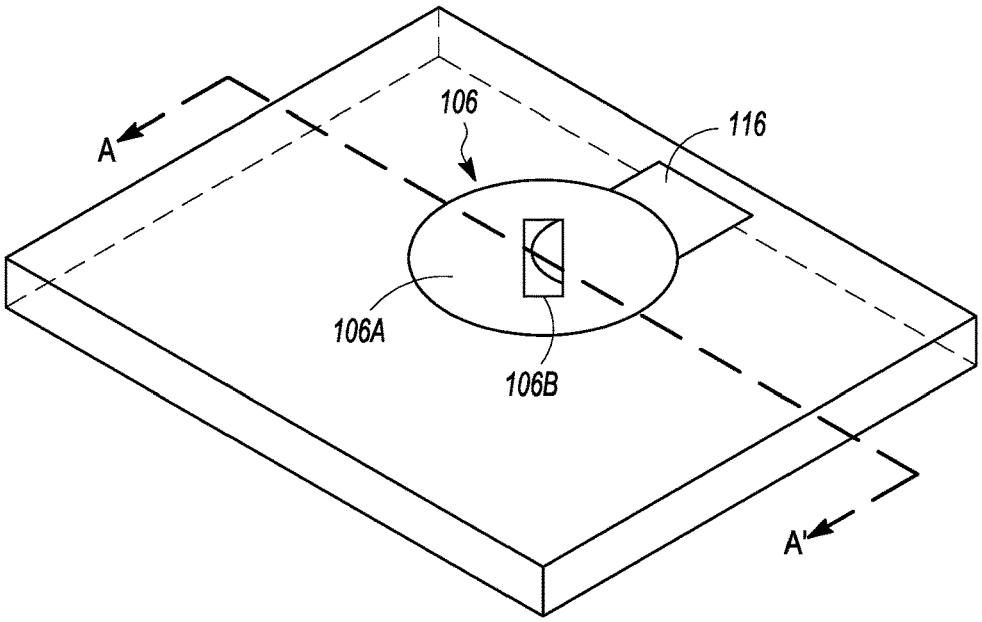
FIG. 4 is a diagram illustrating the slice A-A' of the antenna depicted in FIGS. 5A-5C.

FIG. 3 is a diagram illustrating exemplary operations that can be used to produce the low profile antenna 100. FIG. 3 will be discussed in conjunction with FIGS. 4, 5A-5C, 6, and 7A-7C, which are diagrams depicting the antenna 100 at different stages of a representative production process. FIG.

Figure 5A:
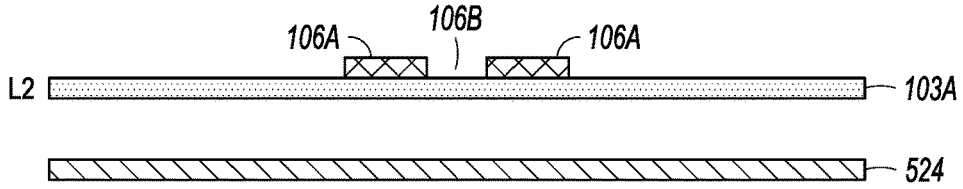
FIGS. 5A-5C are diagrams depicting electrically small antenna at different stages of a representative production process at slice A-A' of FIG. 4.
Figure 5B:
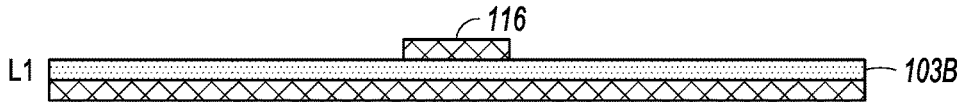
Figure 5C:
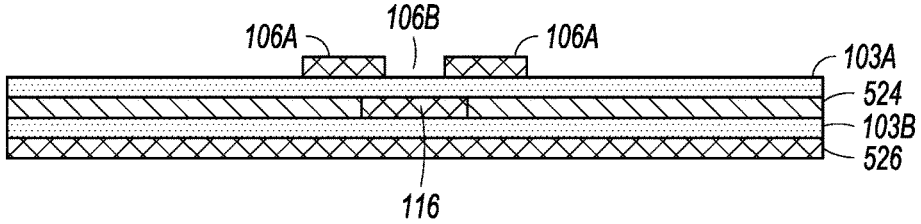
Figure 6:
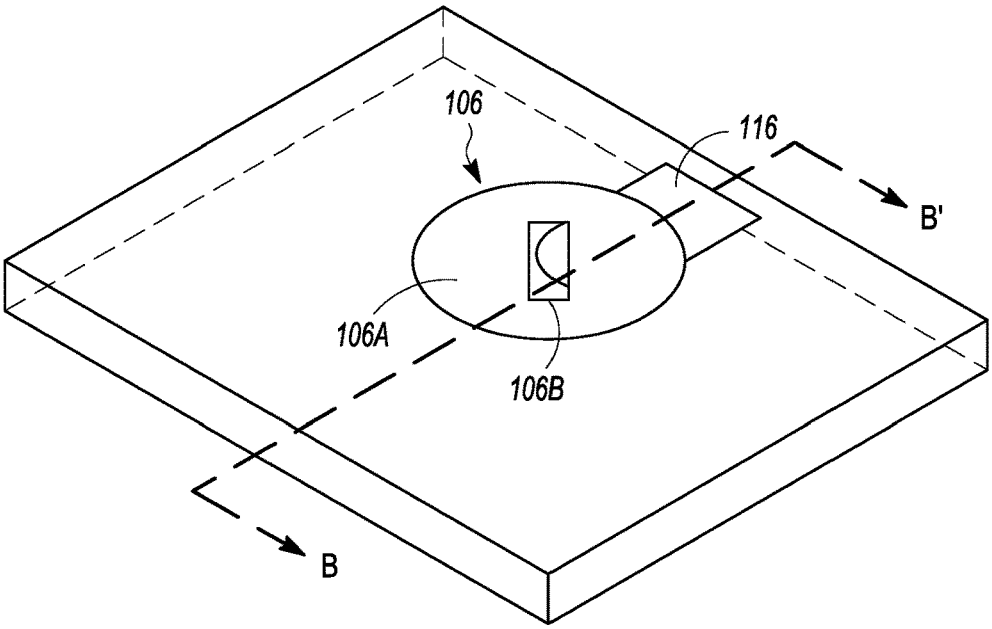
FIG. 6 is a diagram illustrating the slice B-B' of the antenna depicted in FIGS. 7A-7C.
Figure 7A:
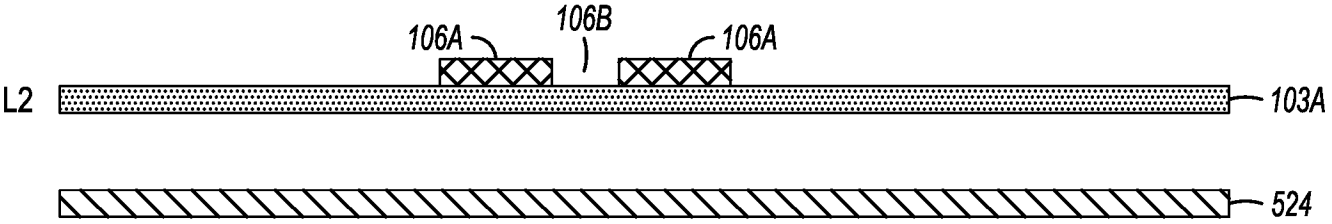
FIGS. 7A-7C, which depict the electrically small antenna at the different stages of the production at the slice B-B' illustrated in FIG. 6.
Figure 7B:
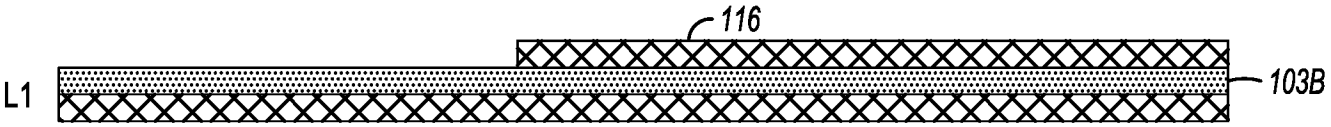
Figure 7C:
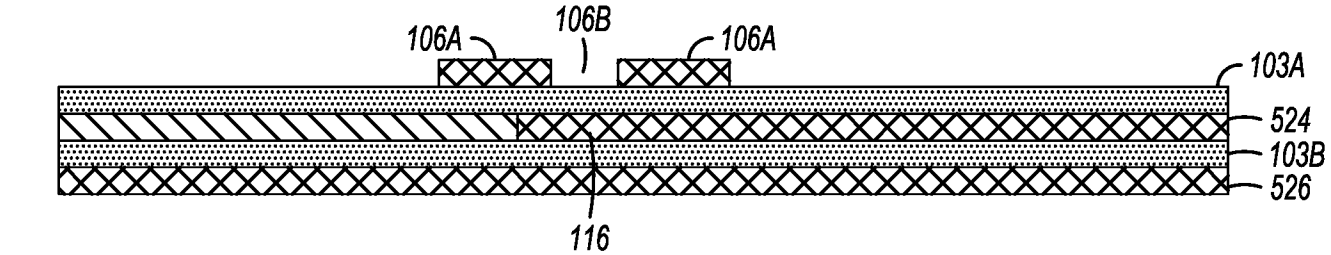

4 is a diagram illustrating the cut A-A' of the antenna 100 depicted in FIGS. 5A-5C, while FIG. 6 is a diagram illustrating the cut B-B' of the antenna 100 depicted in FIGS. 7A-7C.

Turning now to FIG. 3, in block 302, at least one conductive antenna element 106 is disposed on a top surface of a first magnetic layer 103A. This is illustrated in FIGS. 5A and 7A.

In block 304, a conductor 116 is disposed on a top surface of a second magnetic layer 103B, or alternatively, on a bottom surface of the first magnetic layer 103A. This is illustrated in FIGS. 5B and 7B.

In block 306, the first magnetic layer 103A and the second magnetic layer 103B are laminated. Upon lamination, the conductor 116 extends from an antenna input to a location under the conductive antenna element 106 and at least a portion of the conductor 116 forms a microstrip with the second magnetic layer 103B and the bottom surface conductive ground plane 107. This is shown in FIGS. 5C and 7C.

The foregoing steps illustrate the creation of one antenna element 106 on the RF circuit board 101. In other embodiments, the antenna 100 comprises an array of antenna elements 106 such as the 2×2 array of antenna elements illustrated in FIG. 1C. In such cases, the operations disclosed above include analogous operations as applied to any other desired antenna elements 106 in the array.

Furthermore, in any combination or all of the foregoing operations, the disposition of conductive material on the magnetic layers 103A and 103B may be accomplished by additive methods such as printing or film deposition of suitable conductive materials (e.g., silver, copper, etc.) to the appropriate surface of the dielectric. Deposition of conductive material may also be accomplished by combined additive and subtractive methods such as laser etching, milling, or wet etching. Hence, the conductive materials may be deposited on the entire surface of the magnetic layer(s) and unwanted portions etched away. For example, the top of the first magnetic layer 103A may be formed by disposing a conductive material along the entire top surface, then etching or otherwise removing the conductive material from the slot 106B and the area surrounding the conductive antenna element portion 106A.

The lamination of the first magnetic layer 103A and the second magnetic layer 103B, can be accomplished by disposing an adhesive film 524 between the first magnetic layer 103A and the second magnetic layer 103B. Should portions of the adhesive film 524 be removed to achieve the structure shown in FIGS. 5A-5C, such portions may be removed before lamination or processed after lamination (e.g., using an etching technique). Further, magnetic layers 103A and 103B may be created in any order, but unless otherwise noted, should be layered as illustrated before lamination. Nominally, magnetic layers 103A and 103B are composed of a magnetic material but may also include dielectric material portions.

Signal Transception

The foregoing antenna 100 can be used to transmit and/or receive (transceive) signals. In transmission, signals provided to the feed created by conductor 116 are transformed into a transmitted RF signal by antenna elements 106 and associated structures. In reception, RF signals are provided to the antenna elements 106 and associated structures and transformed into a received signal at the conductor 116. For example, referring again to FIG. 1A, when used for transmission, the antenna 100 receives a signal at power input, and this signal is provided by the conductor 116 to the aperture coupled antenna elements 106 for transmission as an RF signal.

Hardware Environment

Figure 8:
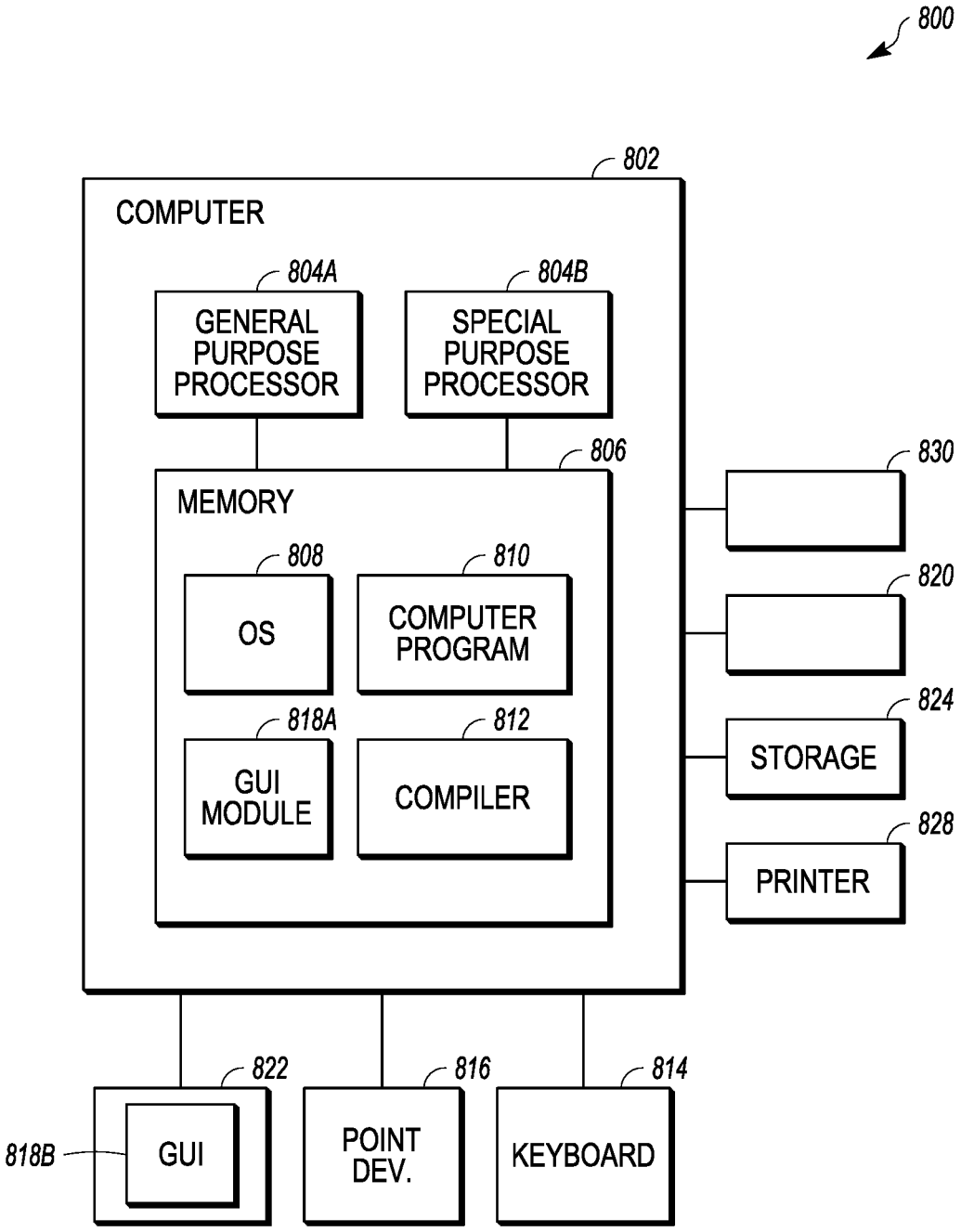
FIG. 8 is a diagram illustrating an exemplary computer system that could be used to implement processing elements of the above disclosure.

FIG. 8 is a diagram illustrating an exemplary computer system 800 that could be used to implement processing elements of the above disclosure, including the defining of the conductive structures and etching of the dielectric layers. The computer 802 comprises at least one processor 804 such as a general purpose processor 804A and/or a special purpose processor 804B and a memory, such as random access memory (RAM) 806. The computer 802 is operatively coupled to a display 822, which presents images such as windows to the user on a graphical user interface 818B. The computer 802 may be coupled to other devices, such as a keyboard 814, a mouse device 816, a printer, etc. Of course, those skilled in the art will recognize that any combination of the above components, or any number of different components, peripherals, and other devices, may be used with the computer 802, including printer 828.

Generally, the computer 802 operates under control of an operating system 808 stored in the memory 806, and interfaces with the user to accept inputs and commands and to present results through a graphical user interface (GUI) module 818A. Although the GUI module 818B is depicted as a separate module, the instructions performing the GUI functions can be resident or distributed in the operating system 808, the computer program 810, or implemented with special purpose memory and processors. The computer 802 also implements a compiler 812 which allows an application program 810 written in a programming language such as COBOL, C++, FORTRAN, or other language to be translated into processor 804 readable code. After completion, the application 810 accesses and manipulates data stored in the memory 806 of the computer 802 using the relationships and logic that was generated using the compiler 812. The computer 802 also optionally comprises an external communication device such as a modem, satellite link, Ethernet card, or other device for communicating with other computers.

In one embodiment, instructions implementing the operating system 808, the computer program 810, and the compiler 812 are tangibly embodied in a computer-readable medium, e.g., data storage device 820, which could include one or more fixed or removable data storage devices, such as a zip drive, floppy disc drive 824, hard drive, CD-ROM drive, tape drive, etc. Further, the operating system 808 and the computer program 810 are comprised of instructions which, when read and executed by the computer 802, causes the computer 802 to perform the operations herein described. Computer program 810 and/or operating instructions may also be tangibly embodied in memory 806 and/or data communications devices 830, thereby making a computer program product or article of manufacture. As such, the terms "article of manufacture," "program storage device" and "computer program product" as used herein are intended to encompass a computer program accessible from any computer readable device or media.

Those skilled in the art will recognize many modifications may be made to this configuration without departing from the scope of the present disclosure. For example, those skilled in the art will recognize that any combination of the above components, or any number of different components, peripherals, and other devices, may be used.

CONCLUSION

This concludes the description of the preferred embodiments of the present disclosure.

The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. A low profile antenna, comprising:

circuit board, comprising:

a composite laminate, formed of a magnetic material and having:

at least one antenna element disposed on a top surface of the composite laminate, wherein the at least one antenna element includes a conductive element portion and a slot;

a conductive ground plane disposed on a bottom surface of the composite laminate wherein the conductive element portion is conductively isolated from the conductive ground plane; and a conductor, extending through the composite laminate between the top surface and the bottom surface of the composite laminate, wherein the conductor forms a microstrip feed extending from an antenna input to the at least one antenna element.

2. The antenna of claim 1, wherein:

at least a portion of the microstrip feed is disposed within the composite laminate between the slot and the conductive ground plane.

3. The antenna of claim 2, wherein:

the top surface comprises an array of a plurality of antenna elements, each comprising an associated slot; and at least a portion of the microstrip feed is disposed within the composite laminate between each of the array of the plurality of antenna elements and the conductive ground plane.

4. The antenna of claim 3, wherein the conductor further forms one or more power dividers disposed between the at least a portion of the microstrip feed disposed under each of the array of the plurality of antenna elements.

5. The antenna of claim 4, wherein:

the composite laminate has a thickness of 500 mil; and the magnetic material has a relative permittivity of 37-38.

6. The antenna of claim 4, wherein:

each antenna element is formed by a first conductive material on a top surface of a first layer of the magnetic material;

the conductor is formed by a second conductive material on bottom surface of the first layer of the magnetic material or a top surface of a second layer of the magnetic material; and the conductive ground plane is formed by a third conductive material on a bottom surface of the second layer of the magnetic material.

7. The antenna of claim 6, wherein:

each antenna element is formed by a first conductive material patterned on a top surface of a first layer of the magnetic material;

the conductor is formed by a second conductive material patterned on the bottom surface of the first layer of the magnetic material or a top surface of a second layer of the magnetic material; and the conductive ground plane is formed by a third conductive material patterned on a bottom surface of the second layer of the magnetic material.

8. The antenna of claim 6 wherein:

each antenna element is formed by a first conductive material printed on a top surface of a first layer of the magnetic material;

the conductor is formed by a second conductive material printed on the bottom surface of the first layer of the magnetic material or a top surface of a second layer of the magnetic material; and the conductive ground plane is formed by a third conductive material printed on a bottom surface of the second layer of the magnetic material.

9. A method of forming a low profile antenna, the method comprising:

disposing at least one conductive antenna element on a top surface of a first magnetic layer;

disposing a conductor on a top surface of a second magnetic layer or a bottom surface of the first magnetic layer, wherein the at least one conductive antenna element includes a conductive element portion and a slot;

laminating the first magnetic layer and the second magnetic layer, wherein upon lamination:

the conductor extends from an antenna input to under the conductive antenna element;

at least a portion of the conductor forms a microstrip between the second magnetic layer and a bottom surface conductive ground plane; and the conductive element portion is conductively isolated from the bottom surface conductive ground plane.

10. The method of claim 9, wherein at least another portion of the conductor is disposed between the first magnetic layer and the second magnetic layer between the slot and the conductive ground plane.

11. The method of claim 10, wherein:

disposing at least one conductive antenna element on a top surface of a first magnetic layer comprises disposing an array of a plurality of antenna elements on a top surface of a first magnetic layer, each of the plurality of antenna elements comprising an associated slot; and the at least another portion of the conductor is disposed between each element of the array of the plurality of antenna elements and the conductive ground plane.

12. The method of claim 11, wherein the conductor further forms one or more power dividers disposed between the at least a portion of the microstrip is disposed under each of the array of the plurality of antenna elements.

13. The method of claim 12, wherein:

the first magnetic layer has a thickness of 250 mil;

the second magnetic layer has a thickness of 250 mil; and the first magnetic layer and the second magnetic layer are formed by a magnetic material having a relative permittivity of 37-38.

14. The method of claim 12, wherein:

each of the plurality of antenna elements is formed by a first conductive material on the top surface of the first magnetic layer;

the conductor is formed by a second conductive material on the bottom surface of the first magnetic layer or a top surface of a second magnetic layer; and the conductive ground plane is formed by a third conductive material on a bottom surface of the second magnetic layer.

15. The method of claim 14, wherein the first conductive material is patterned on the top surface of the first magnetic layer;

the second conductive material is patterned on the bottom surface of the first magnetic layer or a top surface of a second magnetic layer; and the third conductive material is patterned on the bottom surface of the second magnetic layer.

16. The method of claim 14, wherein the first conductive material is printed on the top surface of the first magnetic layer;

the second conductive material is printed on the bottom surface of the first magnetic layer or a top surface of a second magnetic layer; and the third conductive material is printed on the bottom surface of the second magnetic layer.

17. A low profile antenna, formed by performing steps comprising the steps of:

disposing at least one conductive antenna element on a top surface of a first magnetic layer, wherein the at least one conductive antenna element includes a conductive element portion and a slot;

disposing a conductor on a top surface of a second magnetic layer or a bottom surface of the first magnetic layer;

laminating the first magnetic layer and the second magnetic layer, wherein upon lamination:

the conductor extends from an antenna input;

at least a portion of the conductor forms a microstrip with the second magnetic layer and a bottom surface conductive ground plane; and the conductive element portion is conductively isolated from the bottom surface conductive ground plane.

18. The antenna of claim 17, wherein:

at least another portion of the conductor is disposed between the first magnetic layer and the second magnetic layer and between the slot and the conductive ground plane.

19. The antenna of claim 18, wherein:

disposing at least one conductive antenna element on a top surface of a first magnetic layer comprises disposing an array of a plurality of antenna elements on a top surface of a first magnetic layer, each of the plurality of antenna elements comprising an associated slot; and the at least another portion of the conductor is disposed between each element of the array of the plurality of antenna elements and the conductive ground plane.

20. The antenna of claim 19, wherein:

the first magnetic layer has a thickness of about 250 mil;

the second magnetic layer has a thickness of about 250 mil; and the first magnetic layer and the second magnetic layer are formed by a magnetic material having a relative permittivity of 37-38.

21. A method of transmitting a signal, the method comprising:

receiving the signal at an input of a low profile antenna, the antenna comprising:

a circuit board, comprising:

a composite laminate, formed of a magnetic material and having:

at least one antenna element disposed on a top surface of the composite laminate, wherein the at least one antenna element includes a conductive element portion and a slot;

a conductive ground plane disposed on a bottom surface of the composite laminate wherein the conductive element portion is conductively isolated from the conductive ground plane; and a conductor, extending through the composite laminate between the top surface and the bottom surface of the composite laminate, wherein the conductor forms a microstrip feed extending from an antenna input to the at least one antenna element; and transmitting the received signal via the low profile antenna.

* * * * *